US010470557B2

(12) United States Patent
Trent

(10) Patent No.: US 10,470,557 B2
(45) Date of Patent: Nov. 12, 2019

(54) MULTIPLE USE POCKET CLIP

(71) Applicant: James E. Trent, Hortense, GA (US)

(72) Inventor: James E. Trent, Hortense, GA (US)

( * ) Notice: Subject to any disclaimer, the term of this patent is extended or adjusted under 35 U.S.C. 154(b) by 0 days.

(21) Appl. No.: 16/297,679

(22) Filed: Mar. 10, 2019

(65) Prior Publication Data

US 2019/0281963 A1 Sep. 19, 2019

Related U.S. Application Data

(60) Provisional application No. 62/643,307, filed on Mar. 15, 2018.

(51) Int. Cl.
*A45F 5/02* (2006.01)
*B43K 25/02* (2006.01)

(52) U.S. Cl.
CPC ..... *A45F 5/022* (2013.01); *A45F 5/021* (2013.01); *B43K 25/02* (2013.01)

(58) Field of Classification Search
CPC ..... Y10T 24/344; Y10T 24/3443; Y10T 24/3441; Y10T 24/1394; Y10T 24/1391; A45F 5/021; A45F 5/022; B43K 25/02
See application file for complete search history.

(56) References Cited

U.S. PATENT DOCUMENTS 668,088 A * 2/1901 Bruce ..... A45F 5/02 24/3.12
891,920 A * 6/1908 Espelin ..... A45F 5/022 2/250
6,101,689 A * 8/2000 Jo ..... A45F 5/02 24/332
8,595,903 B2 * 12/2013 Miltner ..... A45F 5/02 24/3.11

* cited by examiner

*Primary Examiner* — Robert Sandy

(74) *Attorney, Agent, or Firm* — Jonathan R. Smith; Jonathan Rigdan Smith, J.D., PC

(57) ABSTRACT

A pocket clip for holding various articles on a person's clothing has a spring-loaded strip- or cloth-retaining cam assembly at the upper end and a strap holder at the lower end. The strap holder is pinched closed by a draw latch or snap. The lower end of the clip may include a spacer so dimensioned as to provide space for the latch or snap between the clothing and the cam assembly.

6 Claims, 3 Drawing Sheets

MULTIPLE USE POCKET CLIP

CROSS-REFERENCES TO RELATED APPLICATIONS

This nonprovisional U.S. application for patent claims priority of provisional application No. 62/643,307 filed Mar. 15, 2018.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A BIOLOGICAL SEQUENCE LISTING

Not applicable.

BACKGROUND OF INVENTION

Field of the Invention

This invention is in the fields of supports, tools, and apparel. More specifically it is in the field of clips for securing items to clothing or belts.

Description of the Related Art

There are many clips that allow items to be suspended from belts, such as holsters which have a strap fastened around a belt and a sleeve suspended from the strap into which a firearm or a tool may be inserted. There are also clips that slip over the upper edge of a pocket, with a cavity below for holding items, such as pocket protectors for pens.

BRIEF DESCRIPTION OF THE INVENTION

Objects of the Invention

One problem with existing belt and pocket clips is that an upward force on the clip, or the object attached to, or suspended from, the clip, may cause the clip and whatever is attached to it to dislodge from the belt or clothing. An object of the instant invention is to provide a clip that will securely hold itself to a belt or the edge of a pocket, as well as more securely hold an object suspended from the clip. Another problem with some clips is that they are as wide as some horizontal pocket openings and are therefore too wide for vertical pocket openings. It is therefore desirable to have a pocket clip that can clip to a narrow pocket or the bottom end of a vertical pocket, and serve to hold an article that would otherwise be too wide to hang from the same pocket.

SUMMARY OF THE INVENTION

The present invention is a pocket clip with a narrow spring-loaded strip- or cloth-retaining cam assembly at the upper end and a strap holder at the lower end pinched closed by a draw latch or snap. The lower end of the clip may include a spacer so dimensioned as to provide space for the latch or snap between the clothing and the cam assembly.

These and other benefits will become more clearly illustrated in the following detailed description and drawings.

DETAILED DESCRIPTION OF THE INVENTION

Figure 1:
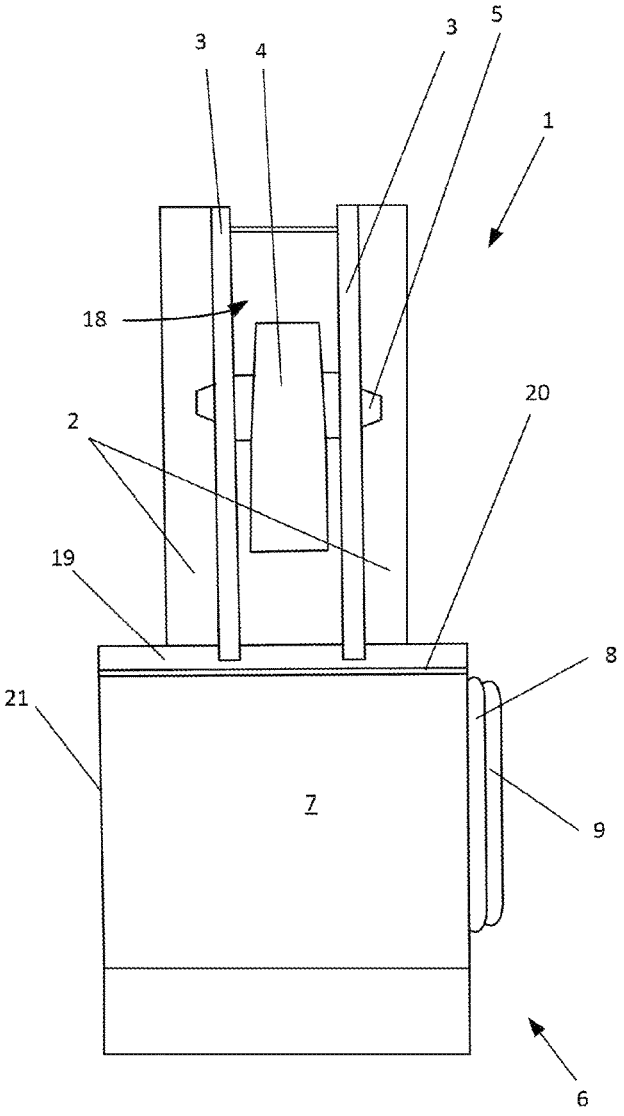
FIG. 1 is a front view of a first embodiment of the instant invention.

Referring now to the drawings, in which like reference characters refer to like elements among all of the drawings, FIG. 1 is a front view of a first embodiment of the instant invention. It comprises an upper end 1 having an inverted U-shaped housing 2. A pair of parallel vertical flanges 3 extend forwardly from the front of the housing 2. A cam assembly 4 is rotatably attached between the flanges 3 by a horizontal axle 5, to that the upper part of the cam assembly 4 extends rearwardly through a rectangular hole 18 in the front of the housing 2. The lower end 6 of the first embodiment comprises a clamp panel 7, which is held closed rearwardly against a back plate 20 by a draw latch loop 8 pulled rearwardly against a vertical loop keeper 9. The clamp panel 7 is flexibly attached to the back plate 20 at the left side in this view by an attachment means 21. In this view, the attachment means 21 is simply a 180-degree bend in the material comprising both the clamp panel 7 and the back plate 20. In other embodiments, the attachment means 21 may be a hinge or other means for allowing the clamp panel 7 to move relative to the back plate 20.

Figure 2:
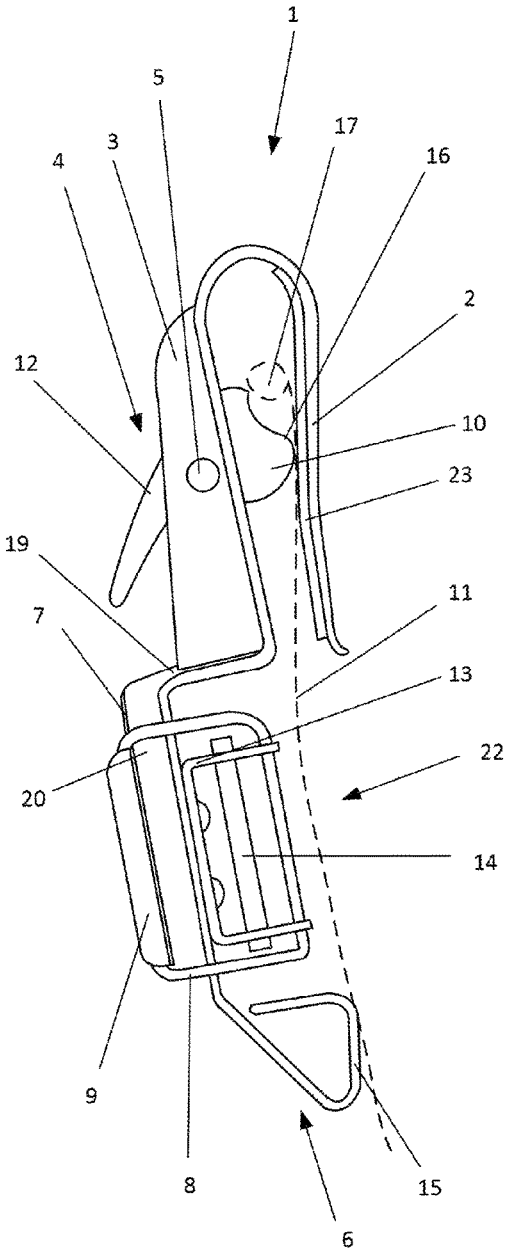
FIG. 2 is a right side view of the first embodiment.

FIG. 2 is a right side view of the first embodiment. It better illustrates the U-shaped housing 2 with the right flange 3 affixed to it. The upper part of the cam assembly 4 extends through the rectangular hole 18 (not visible in this view) causing a cam 10 to grip a clothing item 11 against a grip plate 23 affixed to the rear of the housing 2. The clothing item 11 may be a pocket, seam, or belt and is shown here in dashed lines as environmental structure. A seam 17 is shown here at the top of the clothing item 11 as might exist at the top of a pocket. The cam 10 may be held clockwise in this view against the clothing item 11 by a spring (not shown) about the horizontal axle 5. The right face 16 of the cam part 10 may comprise ribs or teeth to prevent slippage of the clothing item 11. Note that if a force pushes upwardly against the lower end 6, the cam 10 will resist the upward motion relative to the clothing item 11, particularly if a seam 17 exists. The cam part 10 is released from the clothing item 11 by pressing a lever 12 to the right in this view, rotating the cam assembly 4 counterclockwise in this view about the horizontal axle 5.

This figure also better shows detail of the lower end 6, including the back plate 20. The back plate 20 has a draw latch assembly 22 attached to the rear of it (to the right in this view). The draw latch loop 8 engages the loop keeper 9, pulling the clamp panel 7 towards the back plate 20 by means of a draw latch 13. The draw latch 13 rotates about a vertical axle 14 as is commonly known in the art of latches. An optional spacer 15 is provided to hold the lower end 6 away from the clothing item 11 to provide space for the draw latch assembly 22. The upper end 1 of the invention is fixed to the lower end 6 by a horizontal web 19. The U-shaped housing 2 of the upper end 1, the flanges 3, the web 19, the back plate 20 of the lower end, the clamp panel 7 and the optional spacer 15 may be molded or forged from a single piece of material.

Figure 3:
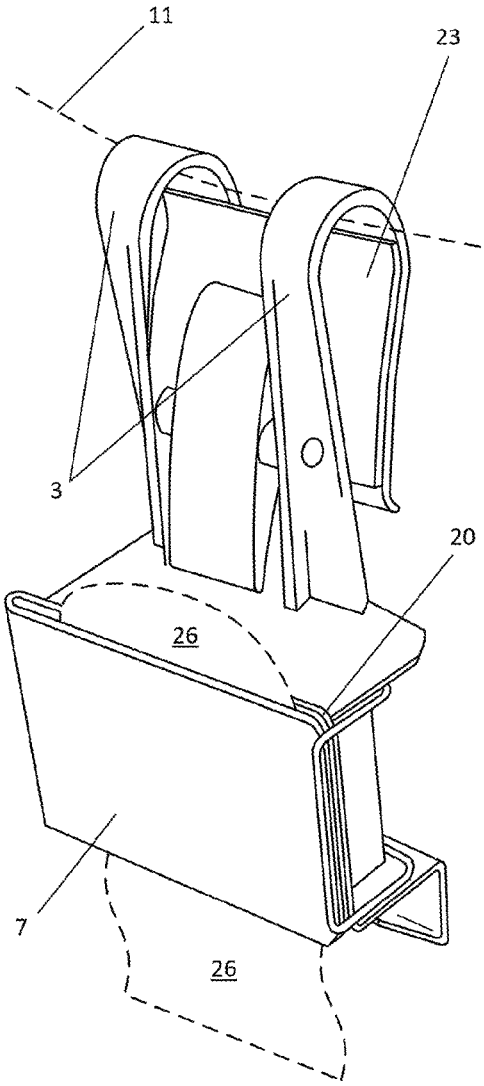
FIG. 3 is an oblique view of the first embodiment from the upper right.

FIG. 3 is an oblique view of the first embodiment from the upper right. It shows the top edge of a clothing item 11 passing from left to right between the grip plate 23 and the flanges 3. It also shows the strap of a tool or holster 26 (shown in dashed lines as environmental structure) pinched between the clamp panel 7 and the back plate 20.

Figure 4:
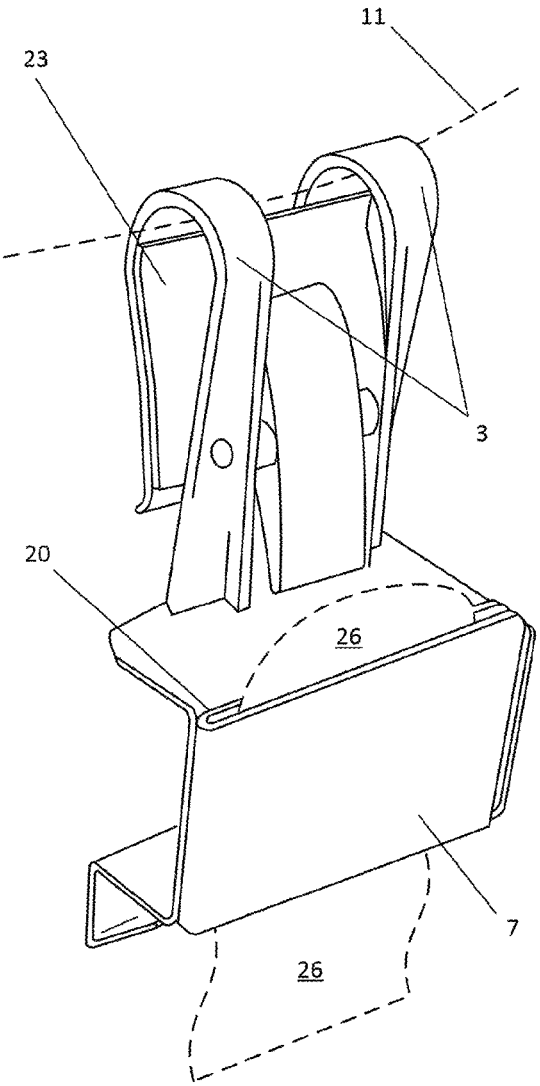
FIG. 4 is an oblique view of the first embodiment from the upper left.

FIG. 4 is an oblique view of the first embodiment from the upper left.

Figure 5:
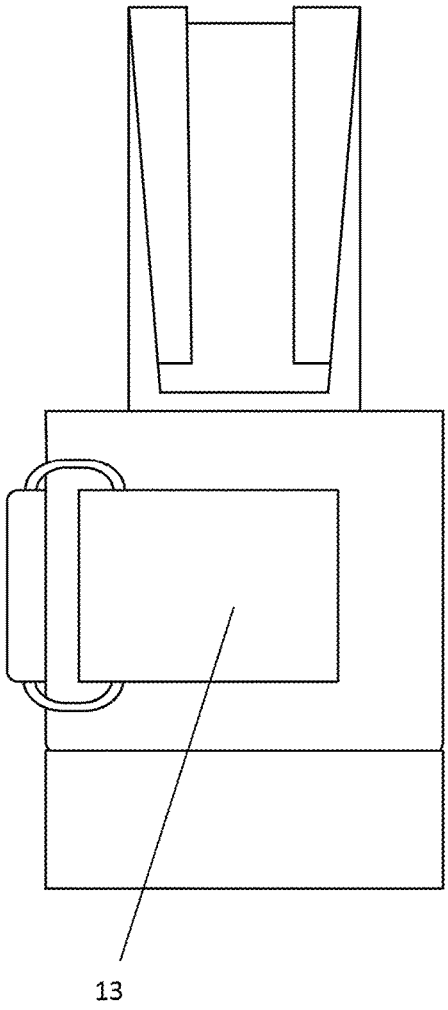
FIG. 5 is a rear view of the first embodiment.

FIG. 5 is a rear view of the first embodiment, providing another view of the draw latch 13.

Figure 6:
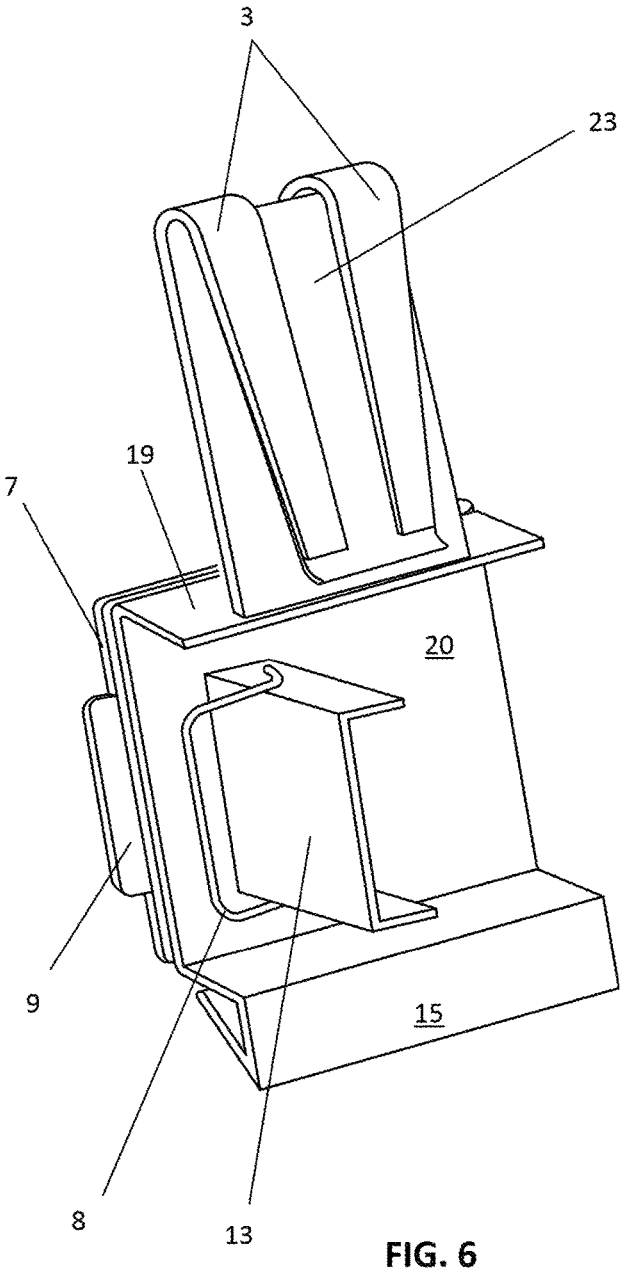
FIG. 6 is an oblique view of the rear of the first embodiment with the draw latch open.

FIG. 6 is an oblique view of the rear of the first embodiment with the draw latch 13 open and the draw latch loop 8 released from the loop keeper 9. This view shows that the flanges 3 are welded to the rear of the grip plate 23, but it is within the scope of this invention to have the flanges welded to the front of the grip plate 23, or forged as one piece with the grip plate 23, the web 19, the back plate 20, the clamp panel 7, and the optional spacer 15.

The instant invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention. This description of the invention should be understood to include all novel and non-obvious combinations of elements described herein, and claims may be presented in a later application to any novel and non-obvious combination of these elements. Moreover, the foregoing embodiments are illustrative, and no single feature or element is essential to all possible combinations that may be claimed a later application.

I claim:

1. A clip for hanging articles from a garment worn by a user, comprising:

a front, a rear, an upper end, and a lower end;

the upper end comprises means for releasably holding the upper edge of a garment; and the lower end comprises a draw latch assembly for releasably holding an article between a clamp panel and a back plate.

2. The clip of claim 1, wherein:

said means includes an inverted U-shaped housing with a pair of parallel vertical flanges in front and a grip plate in the rear;

said inverted U-shaped housing is shaped to accommodate said upper edge of a garment;

the vertical flanges support a horizontal axle therebetween;

a cam assembly rotates on the horizontal axle;

the cam assembly has a cam part and a lever;

the lever rotates the cam part away from the grip plate when pressed by a user;

said upper edge of a garment fits in-between the cam part and the grip plate; and a biasing means rotates the cam part about the horizontal axle towards the grip plate when the lever is not pressed by the user.

3. The clip of claim 2, wherein:

said back plate has an upper back plate edge, a lower back plate edge, a right back plate edge, a left back plate edge, a front back plate surface, and a rear back plate surface;

said clamp panel has a right panel edge, a left panel edge and a rear panel surface;

the left panel edge of the clamp panel is flexibly attached to the left back plate edge of the back plate;

the clamp panel has a loop keeper affixed to its right panel edge;

the draw latch assembly has a rearward depth and is affixed to the rear back plate surface;

the draw latch assembly comprises a draw latch and a draw latch loop;

the draw latch rotates relative to said back plate on a vertical axle; and the rear panel surface is pushed against the front back plate surface when the draw latch loop engages the loop keeper, so that said article can be held between said clamp panel and said back plate.

4. The clip of claim 3, comprising:

a spacer depending from said lower back plate edge; and extending rearwardly from said back plate greater than the rearward depth of said draw latch assembly.

5. A clip for hanging articles from a garment worn by a user, comprising:

a front, a rear, an upper end, and a lower end;

the upper end comprising a means for releasably holding the upper edge of a garment;

the means comprising:

an inverted U-shaped housing being shaped to accommodate said upper edge of a garment;

the rear of the housing being placed between the upper edge and the user's body and comprising a grip plate;

the front of the housing comprising a hole therethrough;

a horizontal axle being placed across the hole;

a cam assembly rotating on the horizontal axle;

the cam assembly having a cam part and a lever;

the lever rotating the cam part away from the grip plate when pressed by a user;

a biasing means rotating the cam part about the horizontal axle towards the grip plate when the lever is not pressed by the user; and the lower end comprising a draw latch assembly for releasably holding an article between a clamp panel and a back plate;

the draw latch assembly having a rearward depth.

6. The clip of claim 5, wherein:

said lower end comprises a back plate and a lower back plate edge; and a spacer depending from the lower back plate edge;

the spacer extending rearwardly from the back plate a distance greater than the rearward depth of said draw latch assembly.

* * * * *